US006375703B1

(12) United States Patent
Chou et al.

(10) Patent No.: US 6,375,703 B1
(45) Date of Patent: Apr. 23, 2002

(54) METHOD OF SYNTHESIZING NICKEL FIBERS AND THE NICKEL FIBERS SO PREPARED

(75) Inventors: Kan-Sen Chou; Chiang-Yuh Ren; Chieh-Tsung Lo, all of Hsinchu (TW)

(73) Assignee: National Science Council, Taipei (TW)

( * ) Notice: Subject to any disclaimer, the term of this patent is extended or adjusted under 35 U.S.C. 154(b) by 0 days.

(21) Appl. No.: 09/690,363

(22) Filed: Oct. 17, 2000

(51) Int. Cl.[7] ..... C22B 3/20; C22B 23/00

(52) U.S. Cl. ..... 75/10.67; 75/347; 75/739; 75/952; 428/606

(58) Field of Search ..... 75/739, 10.67, 75/952, 347; 428/606

(56) References Cited

U.S. PATENT DOCUMENTS 3,406,025 A * 10/1968 Hamling ..... 420/94
3,443,929 A * 5/1969 Kishi et al. ..... 75/363
4,089,676 A 5/1978 Grundy ..... 75/0.5 AA
4,940,596 A * 7/1990 Wright ..... 427/47

* cited by examiner

*Primary Examiner*—Roy King
*Assistant Examiner*—Tima McGuthry-Banks
(74) *Attorney, Agent, or Firm*—Jackson Walker L.L.P.

(57) ABSTRACT

The present invention discloses s novel synthesis method of nickel fibers. The method of the present invention involves reducing nickel ions in an aqueous solution with a reducing agent in the presence of a base, a pH buffer, and a magnetic field or a surfactant at a temperature of 80–100° C. for a period of time, wherein a pH value of the aqueous solution is not less than 11.0 during the period of time, so that nickel fibers are formed in the aqueous solution. The nickel fibers synthesized in the present invention have a diameter ranging from sub-micron to microns, and a length up to centimeters.

67 Claims, 1 Drawing Sheet

METHOD OF SYNTHESIZING NICKEL FIBERS AND THE NICKEL FIBERS SO PREPARED

FIELD OF THE INVENTION

The present invention relates to a method of synthesizing nickel fibers, particularly to a chemical method of synthesizing nickel fibers by oxidation-reduction.

BACKGROUND OF THE INVENTION

In the past few years, nickel has been widely used in the industries. Its major applications include the preparations of mechanical alloy materials, ceramic materials, magnetic materials and catalysts. In the electrical and electronic products, nickel has been used in the preparation of conductive adhesives, EMI shielding and anti-electrostatic materials. Its applications in both the conductive adhesives and EMI shielding materials, nickel has been used as a conductive filler. When the concentration of such a conductive filler in a matrix reaches a threshold, the resistance thereof will have an abrupt decrease thereby changing the matrix from an insulator to a conductor. Such a threshold is called a percolation threshold. However, this threshold will increase when this type of conductive filler is blended with a resin or a plastic, due to poor blending effects. Therefore, in an ordinary process for preparing the conductive adhesives or EMI shielding products, the amount of conductive filler used in the form of particles usually reaches more than 70% by volume in order to assure the electric quality. However, an increase in the amount of conductive filler used means an increase in the cost.

According to reports in the literature, the methods for reducing the percolation threshold of conductive filler mainly comprise: improving the mixing between the conductive filler and the matrix, using a powder form conductive filler with a larger surface area, i.e. a finer powder, and using a conductive filler with a higher aspect ratio, e.g. in the form of flake, fiber and filament.

Currently the methods of synthesizing metal powders include the physical synthesis method and the chemical synthesis method. Common physical synthesis methods include pulverizing and sputtering, etc.; while common chemical synthesis methods include sol-gel, vapor deposition, and the oxidation-reduction method. Take nickel for an example, in the literature or patents, there is no disclosure related to chemical method of synthesizing nickel fibers, and there are only methods of synthesizing nickel powder. In the methods of synthesizing nickel powder, the first approach comprise reducing a nickel precursor with a gaseous reducing agent in a high temperature, e.g. U.S. Pat. Nos. 3,850,612; 4,673,430; and 5,584,908.

The γ-ray irradiation reduction method uses $Co^{60}$ as the radiation source. After irradiating a $NiSO_4$ aqueous solution, nickel ions can be reduced into metal nickel particles. In this method an OH free radical scavenger is added to avoid the monovalent nickel ions from being oxidized into bivalent ions in the solution phase reactions. Otherwise, the yield will be reduced. Furthermore, an increase in the pH value of the reaction mixture will increase the yield. The literature disclosure includes:

Marignier et. al. [Marignier, J. L., J. Belloni, M. O. Delcourt and J. P. Chevalier, Microaggregates of Non-noble Metals and Bimetallic Alloys Prepared by Radiation-induced Reduction, Nature, 317, 344 (1985)] use $NiSO_4$ as the precursor, iso-propanol as the scavenger, and PVA as the surfactant. After γ-ray irradiation, the product has a particle size of 10–20 nm, and the Ni particles have a face-centered cubic (fcc) crystal structure.

Zhu et al. [Zhu, Y. J., Qian Y., Zhang M. W., Chen Z. Y., Chen M. and Zhou G., Preparation and Characterization of Nanocrystalline Nickel Powders by the γ Radiation Method, J. Mater. Sci. Lett., 13, 1243 (1994)] add SDS into the reaction solution as the surfactant, and further add $NH_4OH$ as the alkaline source to maintain the pH of the solution at 10–11 during the reaction thereby inhibiting the oxidation reaction. The yield can reach 90%. The Ni product has a fcc structure with an average particle size of 8–9 nm.

The oxidation-reduction methods can be divided mainly into two classes based on the solvent used, one is deionized water and the other is alcohol. A synthesis method using an alcohol as the solvent is also called a polyol process, in which the solvent is also used as a reduction agent. The polyol methods of synthesizing nickel particles include:

Hegde et al. [Hedge, M. S., D. Larcher, L. Dupont, B. Beaudoin, K. Tekaia-Elhsissen and J. M. Tarascon, Synthesis and Chemical Reactivity of Polyol Prepared Monodispersed Nickel Powders, Solid State Ionics, 93, 33 (1997)] use Pd or Pt as a nucleation agent, PVP as a protection agent, and ethylene glycol as a solvent, in which nickel hydroxide is reduced at 198° C. for 30–40 minutes to yield nickel particles 135 nm in size.

Kurhara et al. [Kurihara, L. K., G. M. Chow and P. E. Schoen, Nanocrystalline Metallic Powders and Films Produced by the Polyol Method, Nanostructured Mater., 5(6), 607 (1995)] disclose that Ni crystals about 20 nm in size can be obtained when a concentration of nickel nitrate of 0.02–0.2M, a reaction temperature of 120° C. and a reaction time of one hour are used.

Typical aqueous phase reactions are:

U.S. Pat. No. 4,089,676 disclose a method of synthesizing micro nickel particles, wherein a nickel precursor is reduced by hydrazine at 88–96° C. in the presence of an alkaline and an antifoam agent made by the Union Carbide Company.

U.S. Pat. No. 3,923,496 uses oxalic acid to reduce nickel nitrate in a nitrogen or carbon dioxide environment thereby obtaining nickel particles over 0.5 μm in size. If an inhibitor (e.g. magnesium oxide) is added, the particle size can be reduced to 0.1 μm.

The methods currently used by the industry for synthesizing nickel fibers include:

(a) Metal nickel, after being molten, is drawn directly to form a filament. However, this method requires a high temperature for heating and the nickel filament can not reach a very small diameter.

(b) Shui and Chung [Shui, X. P. and D. D. L. Chung, Submicron Nickel Filaments Made by Electroplating Carbon Filaments as a New Filler Material for Electromagnetic Interference Shielding, J. Electronic Mater., 24 (2), 107 (1995)] electroplates nickel metal on a carbon fiber, wherein the synthesized nickel fibers can reach a diameter of 0.4 μm and a length of 100 μm when the volume fraction of nickel is 94%. However, this method uses a carbon fiber; therefore, the method is restricted by the dimensions of the carbon fiber. Furthermore, since the electroplating technique is used, the product is difficult to be uniform as a result of the distribution of the electric field. Moreover, the nickel filament produced according to said article still has a carbon core which has a poorer conductivity than a pure nickel filament. The nickel filament synthesized according to said article mainly is used for its EMI effects. Theoretically, better results will be accomplished if the diameter of the metal filament can be further reduced.

Ichiki et al. [Ichiki, M., J. Akedo, K. Mori and Y. Ishikawa, Microstructure of Nickel Whiskers Produced by the Gas Deposition Method, J. Mater. Sci. Lett., 16, 531 (1997)] use a vapor phase deposition method to grown nickel whisker, which comprises evaporating nickel particles by heat (1700° C.), cooling the vapor by an inert gas (e.g. Ar or He), and depositing nickel on a substrate through a nozzle. The nickel filament produced according to said vapor phase deposition technique has a diameter of 100 $\mu$m and a length of 3 mm. However, said vapor phase deposition technique requires a high capital investment in the facilities. Furthermore, the yield will not be too high due to a low concentration in the vapor phase.

SUMMARY OF THE INVENTION

The main objective of the present invention is to provide a chemical method of synthesizing nickel fibers, particularly an oxidation-reduction method in a solution phase.

The present invention basically uses hydrazine as a reducing agent, a solution of nickel salt as a precursor, and suitable additives, to carry out a reduction reaction of nickel ions below 100° C., wherein the reduced nickel is controlled in the form of a filament instead of a powder by using a magnetic field or a surfactant. The nickel fibers produced accordingly can have a length of up to several centimeters; and the reaction will not be too fast to an extent that a portion of the reduced nickel metal deposits on the wall of the reactor causing a reduction in yield. The nickel fibers synthesized according to the present invention can be recovered from the reaction mixture through simple separation and drying; and the nickel fibers so obtained can have a diameter of microns to sub-microns and a length of centimeters.

The synthesis method proposed by the present invention is a liquid phase oxidation-reduction method and has a lower cost in facilities and a faster reaction rate in comparison with the prior art methods of producing nickel filaments. Furthermore, the nickel fibers produced are very easy to be separated from the reaction solution; therefore, the present method is suitable for commercial mass production.

DETAILED DESCRIPTION OF THE INVENTION

Figure 1:
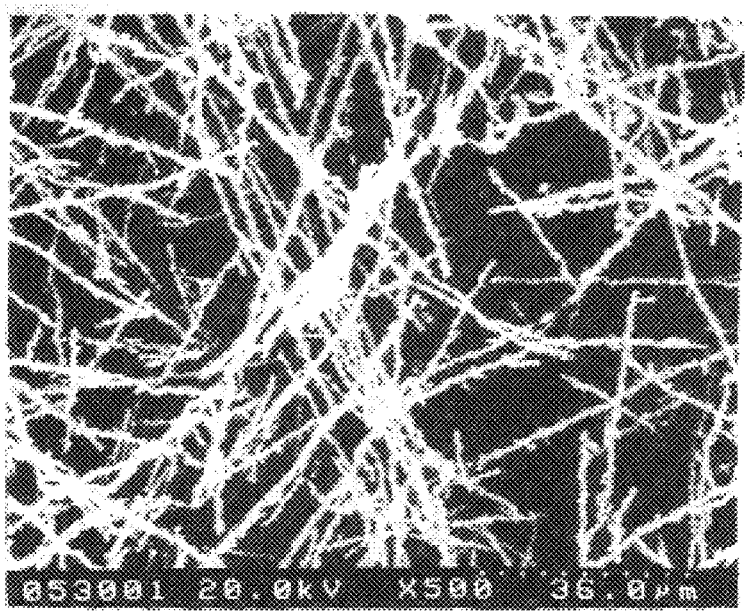
FIG. 1 is a photo of a nickel filament synthesized in Example 1 according to the present invention, taken by a scan electron microscopy (SEM) with a magnification of 500 times.

The present invention provides a method of synthesizing nickel fibers, which comprises:

in an aqueous solution containing nickel ions, in the presence of an alkaline and a pH buffer, and a magnetic field or a surfactant, reducing said nickel ions with a reducing agent at a temperature of 80–100° C., preferably 80–90° C., for a period of time, preferably longer than 5 minutes, to form nickel fibers in said aqueous solution, wherein the pH value of said aqueous solution is not less than 11.0 during said period of time, preferably between 11.5 and 13.0.

Preferably, said aqueous solution containing nickel ions is formed by adding a nickel salt into water, in which said nickel salt can be any nickel salt that can form nickel (II) hydroxide in an alkaline aqueous solution.

Preferably, said nickel salt is nickel chloride, nickel nitrate, nickel acetate, nickel carbonate, nickel sulfate, ammonium nickel sulfate, or a hydrate thereof. More preferably, said nickel salt is $NiCl_2.6H_2O$.

Preferably, said reducing agent is a hydrazine, a hydrazine hydrate or a hydrazine salt. More preferably, said reducing agent is $N_2H_4.H_2O$.

Preferably, said alkaline has a chemical formula of MOH, and said pH buffer has a chemical formula of $M_2HPO_4$, in which M is an alkali metal. More preferably, said alkaline metal hydroxide is KOH, and said pH buffer is $K_2HPO_4$.

In one of the preferred embodiments of the present invention, the concentrations of KOH and $K_2HPO_4$ in said aqueous solution containing nickel ions are 0.125M and 0.25M, respectively.

Preferably, in the present invention, said reducing agent is used in an excess amount in comparison with a stoichiometric amount for reducing said nickel ions in said aqueous solution containing nickel ions. When said reducing agent is a hydrazine, a hydrazine hydrate or a hydrazine salt, preferably, the concentration of said reducing agent in said aqueous solution containing nickel ions is greater than 1.5M. When said reducing agent is $N_2H_4.H_2O$ and said nickel salt is $NiCl_2.6H_2O$, preferably, the concentration of $N_2H_4.H_2O$ in said aqueous solution containing nickel ions is smaller than 10M.

In another one of the preferred embodiments according to the present invention, the concentration of $NiCl_2.6H_2O$ in said aqueous solution containing nickel ions is about 0.05M; and the concentration of $N_2H_4.H_2O$ in said aqueous solution containing nickel ions is about 2.3M.

Preferably, in the method of the present invention, an alkali carbonate and an alkali hydrogen carbonate are added into said aqueous solution containing nickel ions. Said alkali carbonate can be $K_2CO_3$ and said alkali hydrogen carbonate can be $KHCO_3$. Appropriate concentrations of $K_2CO_3$ and $KHCO_3$ in said aqueous solution containing nickel ions are both 0.25M.

Preferably, in the method of the present invention, the reduction of said nickel ions is carried out in the presence of a magnetic field.

Preferably, in the method of the present invention, the reduction of said nickel ions is carried out in the presence of a surfactant. An appropriate concentration of said surfactant in said aqueous solution containing nickel ions is $1\times10^{-4}$M to $1\times10^{-2}$M.

Preferably, in the method of the present invention, the reduction of said nickel ions is carried out in the presence of both a magnetic field and a surfactant.

The present invention also provides nickel fibers. Preferably, said nickel fibers have a diameter of 0.1 to 20 microns, and a length of 1–100 millimeters. More preferably, said nickel fibers have a diameter of 0.5 to 5 microns, and a length of 0.5–50 millimeters.

EXAMPLE 1

10 ml of a solution containing nickel ions including 0.45M of $KHCO_3$, 0.65M of $N_2H_4.H_2O$, 0.50M of $K_2CO_3$, 0.10M of $NiCl_2.6H_2O$, 0.50M of $K_2HPO_4$ and 0.25M of KOH, and 8 ml of deionized water were mixed in a beaker. The mixed solution was placed in a water bath preheated to 80° C. Said water bath was placed on a PMC 500 series analog hotplate-stirrers (Model No. 502 from Barnstead/Thermolyne, Iowa, US) and the temperature was controlled at 80–90° C. While the beaker was heated at 80° C., 2 ml of 98% $N_2H_4.H_2O$ (hydrazine hydrate) and 0.0046 g ($7.98\times10^{-4}$M) of sodium dodecylbenzene sulfonate (SDS) were promptly added. After 10 minutes of heating, the solution's color changed from light blue to dark blue while nickel fibers were formed gradually. After 20 minutes of heating, the solution turned into colorless which was used as an indication of the completion of the reactions. The yield can exceed 90%. Most of the nickel fibers formed precipitated at the bottom of the container, while a small amount of the synthesized nickel fibers that are shorter in length floated in the upper portion of the solution. Upon completion of the reactions, the reaction mixture was filtered to obtain solid nickel fibers after drying.

Figure 2:
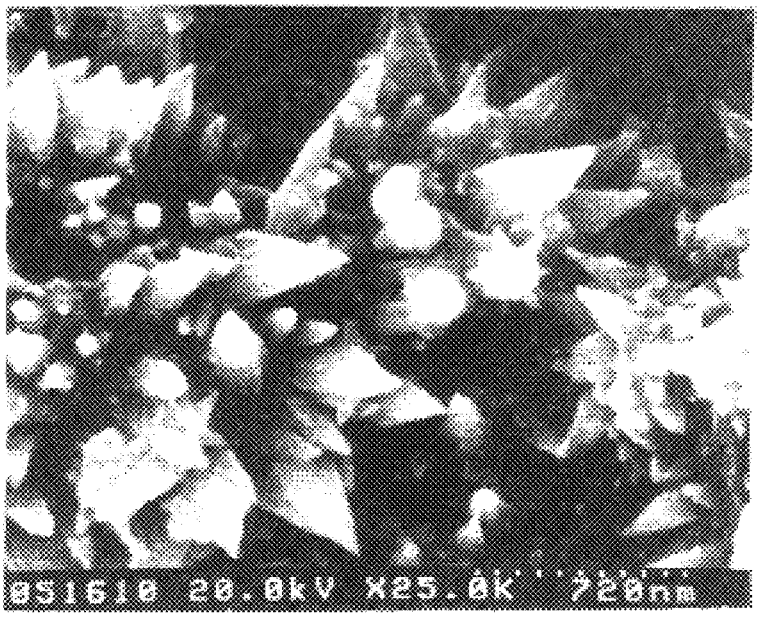
FIG. 2 is a photo of a nickel filament synthesized in Example 1 according to the present invention, taken by a scan electron microscopy (SEM) with a magnification of 2500 times.

Through observations using an electronic microscope, the nickel fibers synthesized according to this example have a length of more than hundreds of microns, and a diameter between microns and sub-microns, as shown by the SEM photo of FIG. 1. On the surfaces of the nickel fibers many long crystals have grown as shown in the SEM photo of FIG. 2. Through the X-ray diffraction analysis (XRD), the crystal structure of the nickel fibers synthesized according to the present invention is excellent. The nickel fibers synthesized have a specific surface area of about 2.73 $m^2/g$.

EXAMPLE 2

In this example, the reaction conditions of Example 1 were repeated except that various reaction temperatures were used to observe the effect of reaction temperature on the growth of nickel fibers. The reaction complete time is defined as the instant when the color of the solution changes from blue to colorless. The reaction results are shown in the following:

| Run | Reaction temp. | Reaction completion time | Characteristics of nickel product |
|---|---|---|---|
| RT1 | 60–70° C. | 150 minutes | Forms a complete network structure of nickel fibers |
| RT2 | 80–90° C. | 20 minutes | Nickel fibers having a length upto several centimeters |
| RT3 | 100–110° C. | 12 minutes | Most of the nickel was plated on the beaker wall, and only a small amount was a filament product |

When the reaction temperature was 60–70° C., the reduced nickel used spots at the bottom of the reactor as a nucleation center and grew into a network structure of nickel fibers, without any nickel fiber suspending in the solution. When the reaction temperature was 80–90° C., the synthesized nickel fibers also used spots at the bottom of the reactor as a nucleation center; however, there were some nickel fibers suspending in the solution. This phenomena can be explained as follows: due to a faster growth rate, nickel fibers grown will have a smaller diameter, and thus are liable to break away by the convection flow of the solution, so that the nickel fibers formed suspends in the solution. When the reaction temperature is increased to 100–110C., a layer of nickel was deposited on the wall of the reactor in 5 minutes after start of the reaction. Upon completion of the reactions, most of the nickel formed was plated on the wall of the reactor, and only a small amount of nickel was grown into nickel fibers which were connected to the nickel plated on the reactor wall. Obviously this is not an ideal reaction condition. This example shows that when the reaction temperature is too high, the reactions are accelerated, creating over-saturation of nickel, thereby inducing the nickel to nucleate on the reactor wall, and thus a result similar to silver mirror is obtained. In this example, the run RT1 has a yield of 86.9%. The nickel fibers synthesized in the run RT1 have a specific surface area of 11.8 $m^2/g$.

EXAMPLE 3

The objective of this example is to investigate the growth of nickel fibers at different concentrations of SDS. The synthesis procedures and conditions were identical to those used in Example 1, except that the concentration of the surfactant SDS was varied. The concentration of SDS used was between $1\times10^{-4}$ to $8\times10^{-3}$M, the reaction conditions and results are shown in the following:

| Run | [SDS] (M) | Reaction completion time | Characteristics of nickel product |
|---|---|---|---|
| SC1 | 0 | 20 minutes | Nickel fibers with a length up to several centimeters |
| SC2 | $2.93\times10^{-4}$ | 90 minutes | Nickel fibers with a length of only several microns to millimeters |
| SC3 | $7.98\times10^{-4}$ | 20 minutes | Nickel fibers with a length up to several centimeters |
| SC4 | $1.60\times10^{-3}$ | 20 minutes | Nickel fibers with a length up to several centimeters |
| SC5 | $3.99\times10^{-3}$ | 10 minutes | Most of the nickel was plated on the beaker wall, and only a small amount was nickel fiber with a length up to several centimeters |
| SC6 | $7.98\times10^{-3}$ | 5 minutes | Most of the nickel was plated on the beaker wall, and only a small amount was nickel fiber with a length upto several centimeters |

In the runs of SC1, SC3 and SC4, when the color of the solution changed from blue to colorless, the time was about 20 minutes. A portion of the nickel fibers formed suspended in the upper portion of the solution. A portion of the fibers were connected to spots at the bottom of the reactor, i.e. using the spots as the nucleation center. However, in the runs SC5 and SC6, the reaction time was shorter and most of the reduced nickel was deposited on the reactor wall, while only a small amount of the reduced nickel existed in the form of nickel fibers. Therefore, the amount of SDS used should not be too high. If the amount of addition of SDS is too small, a longer reaction time will be needed due to a lower reaction, and the nickel fibers formed also are shorter, as shown by the run SC2. The yields of SC1 and SC4 are 81.7% and 92.5%, respectively. The specific surface area of the nickel fibers synthesied in the run SC4 is 7.3 $m^2/g$.

EXAMPLE 4

The surfactant used in the previous three examples is an anionic surfactant which can accelerate the reaction rate. However, a silver mirror reaction occurs if the concentration of the surfactant is too high. In this example, the synthesis procedures and conditions were identical to those used in Example 1, with the exception that a cationic surfactant and a non-ionic surfactant were used. In this example, the cationic surfactant used is C16TABr (hexadecyltrimethylammonium bromide), and the non-ionic surfactant used is Tween 80 (polyoxyethylenesorbitan monooleate). The reaction results are as follows:

| Type & concentration of surfactant | Reaction completion time | Characteristics of nickel product |
|---|---|---|
| [C16TABr] = $9.60 \times 10^{-4}$ M | 50 minutes | Nickel fibers with a length upto several centimeters |
| [C16TABr] = $9.60 \times 10^{-3}$ M | 10 minutes | Most of the nickel was plated on the beaker wall, and only a small amount was nickel fiber with a length upto several centimeters |
| [Tween 80] = $1.74 \times 10^{-3}$ M | 195 minutes | Nickel fibers with a length upto several centimeters |
| [Tween 80] = $9.80 \times 10^{-3}$ M | 15 minutes | Nickel fibers with a length upto several centimeters |
| [Tween 80] = $9.83 \times 10^{-2}$ M | 5 minutes | Most of the nickel was plated on the beaker wall, and only a small amount was nickel fiber with a length upto several centimeters |

For C16TABr and Tween 80, an increase in the concentration of the surfactant will accelerate the reaction. In the runs having lower concentrations, the reaction rates were slower than the case where no surfactant was added. Moreover, the nickel product obtained was in the fibrous form with a portion thereof suspended in the upper portion of the solution, and another portion grown at the bottom of the reactor by using spots thereon as the nucleation center. The nickel fibers were easily recovered from the solution as a product by filtering and drying, and the yields were high. In the case where the concentration of the surfactant was high, most of the nickel reduced was plated on the reactor wall due to a faster reaction rate, and only a small amount of nickel fibers was produced. The above data indicate that ideal product of nickel fibers can not be obtained if the reaction rate is too high. However, the product rate of nickel fibers will be low, if a slower reaction rate is used. The yields of the runs having lower concentrations in this example are about 82–86%. The specific surface area of the nickel fibers synthesized in the run of [C16TABr]=$9.60\times10^{-4}$ M is 10.0 $m^2/g$.

EXAMPLE 5

This example investigates the growth of nickel fibers at different concentrations of the reducing agent (hydrazine). The synthesis procedures and conditions were identical to those used in Example 1, except that the amount of hydrazine used was varied and no surfactant was used. The total volume of the solution was fixed at 20 ml by adjusting the volume of the deionized water used. The reaction results are as follows:

| Run | Conc. of hydrazine (M) | Reaction completion time | Characteristics of nickel product |
|---|---|---|---|
| HC1 | 0 | >8 hours | Nickel fibers with a length only several microns to several millimeters |
| HC2 | 1.325 | 85 minutes | Nickel fibers with a length only several microns to several millimeters |
| HC3 | 2.325 | 20 minutes | Nickel fibers with a length up to several centimeters |
| HC4 | 5.325 | 20 minutes | Nickel fibers with a length up to several centimeters |

-continued

| Run | Conc. of hydrazine (M) | Reaction completion time | Characteristics of nickel product |
|---|---|---|---|
| HC5 | 8.325 | 19 minutes | Nickel fibers with a length up to several centimeters |
| HC6 | 10.325 | 21 minutes | Nickel fibers with a length up to several centimeters |

The above data show that when the concentration of the hydrazine is low, the reaction rate is slower and the nickel fibers formed are shorter. However, when the concentration reaches 2.325M, the growth rate of nickel fibers and the reaction rate are no longer affected by the concentration of the hydrazine.

EXAMPLE 6

In this example, the influence of the composition of the reaction solution on the formation of nickel fibers was investigated. The reaction solution used in Example 1 comprises: $N_2H_4.H_2O$ $NiCl_2.6H_2O$, $KHCO_3$, $K_2CO_3$, $K_2HPO_4$, KOH and a surfactant. In this example, the surfactant, $KHCO_3$, $K_2CO_3$ and $K_2HPO_4$ were stopped using gradually, while maintaining the other conditions identical to those used in Example 1. The reaction results are as follows:

| Run | Composition of solution | Reaction completion time | Characteristics of nickel product |
|---|---|---|---|
| ELC1 | $KHCO_3$, $N_2H_4.H_2O$, $K_2CO_3$, $NiCl_2.6H_2O$, $K_2HPO_4$ and KOH | 20 minutes | Nickel fibers with a length up to several centimeters |
| ELC2 | $N_2H_4.H_2O$, $NiCl_2.6H_2O$, $K_2HPO_4$ and KOH | 20 minutes | Nickel fibers with a length up to several centimeters |
| ELC3 | $N_2H_4.H_2O$, $NiCl_2.6H_2O$ and KOH | 5 minutes | Nickel fiber with a length only several microns |

The purpose of adding potassium hydrogen carbonate is to form a stable hydrazine carboxylate in the solution, thereby avoiding a premature formation of nickel by a reduction reaction during storage. The function of the potassium carbonate is to assist the stability of the hydrazine carboxylate in the solution. If there is no carboxylate ions, a precipitation of nickel hydroxide will be formed in the solution. However, this situation will not adversely affect the formation of nickel fibers, as verified from the results of ELC2. This also explains that nickel hydroxide is an intermediate product in the reaction process. Therefore, any salts of nickel, for examples nickel chloride, and nickel nitrate, etc., which can form nickel hydroxide in an alkaline solution can be used in the method of the present invention. In the case of ELC3, the reaction rate is significantly increased, causing the length of the nickel fibers to be extremely short, when no phosphate ions are added as a buffer. This also indicates that the pH value of the solution should also be an important experimental parameter.

EXAMPLE 7

In this example, the synthesis procedures and conditions used in the run ELC2 of Example 6 were repeated except that the amount of KOH was varied to investigate the effect of pH value on the growth of nickel fibers. The reaction results are shown as follows:

| Initial pH value in the solution | Reaction completion time | Characteristics of nickel product |
|---|---|---|
| 14.24 | 6 minutes | Nickel fibers with a length of several microns to several millimeters |
| 13.16 | 10 minutes | Nickel fibers with a length of several microns to several millimeters |
| 12.88 | 14 minutes | Nickel fibers with a length of several centimeters |
| 12.24 | (not measured) | Nickel fibers with a length of several centimeters |
| 11.79 | 20 minutes | Nickel fibers with a length of several millimeters |
| 11.39 | | Nickel fibers with a length of several millimeters; however the yield is very low |
| 10.95 (without addition of KOH) | No reaction occurs after 7 hours | No formation of nickel fibers |

When the pH value exceeds 13.16, the formation rate of nickel fibers is faster and the length of the fibers are also shorter. When the pH value reaches 14.24, a small amount of nickel foils form on the nickel fibers. In the two runs where the pH values are 11.79 and 12.88, respectively, the nickel fibers have a longer length and are more suitable to be used as a conductive filler. When the pH value is smaller than 11, no reaction occurs in the solution after more than 7 hours. The yield of the run where pH=12.88 is 90.3%.

EXAMPLE 8

In this example, the procedures of Example 1 was repeated, except that a regular hot plate was used to replace the PMC 500 series analog hotplate-stirrers. The water bath was placed on the regular hotplate having no magnetic field to observe the growth of nickel fibers in the absence of a magnetic field. The results show that the time to complete the reactions increases to 90 minutes and nickel fibers having a length up to several centimeters were formed.

Control Example 1

In this control example, the runs ELC2, ELC2 and ELC3 in Example 6 were repeated except that a regular hot plate was used to replace the PMC 500 series analog hotplate-stirrers. The water bath was placed on the regular hotplate having no magnetic field to observe the growth of nickel fibers in the absence of a magnetic field. The results show that the reactions were still not completed after two hours from the start of the reaction, and only tiny fibrous product with a length of several microns was formed.

Although the present invention has been described with reference to specific details of certain embodiments thereof, it is not intended that such details should be regarded as limitations upon the scope of the invention except as and to the extent that they are included in the accompanying claims. Many modifications and variations are possible in light of the above disclosure.

What is claimed is:

1. A method of synthesizing nickel fibers comprising in an aqueous solution containing nickel ions, in the presence of an alkaline, a pH buffer and a magnetic field, reducing said nickel ions with a reducing agent at a temperature of 80–100° C. for a period of time to form nickel fibers in said aqueous solution, wherein said aqueous solution has a pH value not less than 11.0 during said period of time.

2. The method according to claim 1, wherein said pH value ranges from 11.5 to 13.0.

3. The method according to claim 1, wherein said temperature ranges from 80 to 90° C.

4. The method according to claim 1, wherein said period of time is longer than 5 minutes.

5. The method according to claim 1, wherein said aqueous solution containing nickel ions is formed by adding a nickel salt into water, in which said nickel salt is any nickel salt that can form nickel (II) hydroxide in an alkaline aqueous solution.

6. The method according to claim 5, wherein said nickel salt comprises nickel chloride, nickel nitrate, nickel acetate, nickel carbonate, nickel sulfate, ammonium nickel sulfate, or a hydrate thereof.

7. The method according to claim 6, wherein said nickel salt is $NiCl_2.6H_2O$.

8.The method according to claim 1, wherein said reducing agent is a hydrazine, a hydrazine hydrate or a hydrazine salt.

9. The method according to claim 8, wherein said reducing agent is $N_2H_4.H_2O$.

10. The method according to claim 8, wherein said alkaline has a chemical formula of MOH, in which M is an alkali metal.

11. The method according to claim 10, wherein said alkaline is KOH.

12. The method according to claim 10, wherein said pH buffer has a chemical formula Of $M_2HPO_4$, in which M is defined as in claim 10.

13. The method according to claim 11, wherein said pH buffer is $K_2HPO_4$.

14. The method according to claim 13, wherein concentrations of KOH and $K_2HPO_4$ in said aqueous solution containing nickel ions are about 0.125M and about 0.25M, respectively.

15. The method according to claim 5, wherein said reducing agent is used in an excess amount in comparison with a stoichiometric amount for reducing said nickel ions in said aqueous solution containing nickel ions.

16. The method according to claim 15, wherein said reducing agent is a hydrazine, a hydrazine hydrate or a hydrazine salt, and said reducing agent is used in an amount such that its concentration in said aqueous solution containing nickel ions is greater than 1.5M.

17. The method according to claim 16, wherein said reducing agent is $N_2H_4.H_2O$, and said nickel salt is $NiCl_2.6H_2O$, wherein $N_2H_4.H_2O$ is used in an amount such that its concentration in said aqueous solution containing nickel ions is smaller than 10M.

18. The method according to claim 17, wherein $NiCl_2.6H_2O$ is used in an amount such that its concentration in said aqueous solution containing nickel ions is about 0.05M; and the concentration of $N_2H_4.H_2O$ in said aqueous solution containing nickel ions is about 2.3M.

19. The method according to claim 17, wherein said alkaline has a chemical formula of MOH, in which M is an alkali metal.

20. The method according to claim 19, wherein said alkaline is KOH.

21. The method according to claim 19, wherein said pH buffer has a chemical formula of $M_2HPO_4$, in which M is defined as in claim 19.

22. The method according to claim 20, wherein said pH buffer is $K_2HPO_4$.

23. The method according to claim 22, wherein concentrations of KOH and $K_2HPO_4$ in said aqueous solution containing nickel ions are about 0.125M and about 0.25M, respectively.

24. The method according to claim 1, wherein a surfactant is added to said aqueous solution containing nickel ions.

25. The method according to claim 24, wherein said surfactant is added to said aqueous solution containing nickel ions such that its concentration in said aqueous solution containing nickel ions ranges from $1\times10^{-4}$M to $1\times10^{-2}$M.

26. The method according to claim 9, wherein an alkali carbonate and an alkali hydrogen carbonate are added to said aqueous solution containing nickel ions.

27. The method according to claim 17, wherein an alkali carbonate and an alkali hydrogen carbonate are added to said aqueous solution containing nickel ions.

28. The method according to claim 26, wherein said alkali carbonate is $K_2CO_3$ and said alkali hydrogen carbonate is $KHCO_3$.

29. The method according to claim 27, wherein said alkali carbonate is $K_2CO_3$ and said alkali hydrogen carbonate is $KHCO_3$.

30. The method according to claim 28, wherein concentrations of $K_2CO_3$ and $KHCO_3$ in said aqueous solution containing nickel ions are both 0.25M.

31. The method according to claim 29, wherein concentrations of $K_2CO_3$ and $KHCO_3$ in said aqueous solution containing nickel ions are both 0.25M.

32. Nickel fibers synthesized by the method according to any one claim of claims 1 to 31.

33. The nickel fibers according to claim 32, wherein said nickel fibers have a diameter of 0.1 to 20 microns, and a length of 1 to 100 millimeters.

34. The nickel fibers according to claim 33, wherein said nickel fibers have a diameter of 0.5 to 5 microns, and a length of 5 to 50 millimeters.

35. A method of synthesizing nickel fibers comprising in an aqueous solution containing nickel ions, in the presence of an alkaline, a pH buffer and a surfactant, reducing said nickel ions with a reducing agent at a temperature of 80–100° C. for a period of time to form nickel fibers in said aqueous solution, wherein said aqueous solution has a pH value not less than 11.0 during said period of time.

36. The method according to claim 35, wherein said pH value ranges from 11.5 to 13.0.

37. The method according to claim 35, wherein said temperature ranges from 80 to 90° C.

38. The method according to claim 35, wherein said period of time is longer than 5 minutes.

39. The method according to claim 35, wherein said aqueous solution containing nickel ions is formed by adding a nickel salt into water, in which said nickel salt is any nickel salt that can form nickel (II) hydroxide in an alkaline aqueous solution.

40. The method according to claim 39, wherein said nickel salt comprises nickel chloride, nickel nitrate, nickel acetate, nickel carbonate, nickel sulfate, ammonium nickel sulfate, or a hydrate thereof.

41. The method according to claim 40, wherein said nickel salt is $NiCl_2.6H_2O$.

42. The method according to claim 35, wherein said reducing agent is a hydrazine, a hydrazine hydrate or a hydrazine salt.

43. The method according to claim 42, wherein said reducing agent is $N_2H_4.H_2O$.

44. The method according to claim 42, wherein said alkaline has a chemical formula of MOH, in which M is an alkali metal.

45. The method according to claim 44, wherein said alkaline is KOH.

46. The method according to claim 44, wherein said pH buffer has a chemical formula of $M_2HPO_4$, in which M is defined as in claim 44.

47. The method according to claim 45, wherein said pH buffer is $K_2HPO_4$.

48. The method according to claim 47, wherein concentrations of KOH and $K_2HPO_4$ in said aqueous solution containing nickel ions are about 0.125M and about 0.25M, respectively.

49. The method according to claim 39, wherein said reducing agent is used in an excess amount in comparison with a stoichiometric amount for reducing said nickel ions in said aqueous solution containing nickel ions.

50. The method according to claim 49, wherein said reducing agent is a hydrazine, a hydrazine hydrate or a hydrazine salt, and said reducing agent is used in an amount such that its concentration in said aqueous solution containing nickel ions is greater than 1.5M.

51. The method according to claim 50, wherein said reducing agent is $N_2H_4.H_2O$, and said nickel salt is $NiCl_2.6H_2O$, wherein $N_2H_4.H_2O$ is used in an amount such that its concentration in said aqueous solution containing nickel ions is smaller than 10M.

52. The method according to claim 51, wherein $NiCl_2.6H_2O$ is used in an amount such that its concentration in said aqueous solution containing nickel ions is about 0.05M; and the concentration of $N_2H_4.H_2O$ in said aqueous solution containing nickel ions is about 2.3M.

53. The method according to claim 51, wherein said alkaline has a chemical formula of MOH, in which M is an alkali metal.

54. The method according to claim 53, wherein said alkaline is KOH.

55. The method according to claim 53, wherein said pH buffer has a chemical formula of $M_2HPO_4$, in which M is defined as in claim 19.

56. The method according to claim 54, wherein said pH buffer is $K_2HPO_4$.

57. The method according to claim 56, wherein concentrations of KOH and $K_2HPO_4$ in said aqueous solution containing nickel ions are about 0.125M and about 0.25M, respectively.

58. The method according to claim 35, wherein said surfactant is added to said aqueous solution containing nickel ions such that its concentration in said aqueous solution containing nickel ions ranges from $1\times10^{-4}$M to $1\times10^{-2}$M.

59. The method according to claim 43, wherein an alkali carbonate and an alkali hydrogen carbonate are added to said aqueous solution containing nickel ions.

60. The method according to claim 51, wherein an alkali carbonate and an alkali hydrogen carbonate are added to said aqueous solution containing nickel ions.

61. The method according to claim 59, wherein said alkali carbonate is $K_2CO_3$ and said alkali hydrogen carbonate is $KHCO_3$.

62. The method according to claim 60, wherein said alkali carbonate is $K_2CO_3$ and said alkali hydrogen carbonate is $KHCO_3$.

63. The method according to claim 61, wherein concentrations of $K_2CO_3$ and $KHCO_3$ in said aqueous solution containing nickel ions are both 0.25M.

64. The method according to claim 62, wherein concentrations of $K_2CO_3$ and $KHCO_3$ in said aqueous solution containing nickel ions are both 0.25M.

65. Nickel fibers synthesized by the method according to any one claim of claims 35 to 64.

66. The nickel fibers according to claim 65, wherein said nickel fibers have a diameter of 0.1 to 20 microns, and a length of 1 to 100 millimeters.

67. The nickel fibers according to claim 66, wherein said nickel fibers have a diameter of 0.5 to 5 microns, and a length of 5 to 50 millimeters.

* * * * *